US005696489A

United States Patent [19]

Haynes et al.

[11] Patent Number: 5,696,489

[45] Date of Patent: Dec. 9, 1997

[54] WIRELESS BOUNDARY MONITOR SYSTEM AND METHOD

[75] Inventors: Howard D. Haynes, Knoxville; Curtis W. Ayers, Kingston, both of Tenn.

[73] Assignee: Lockheed Martin Energy Systems, Inc., Oak Ridge, Tenn.

[21] Appl. No.: 584,871

[22] Filed: Jan. 11, 1996

[51] Int. Cl.[6] ..... G08B 13/16

[52] U.S. Cl. ..... 340/541; 181/139; 367/117; 367/191; 367/901; 367/903

[58] Field of Search ..... 340/541, 556, 340/557; 181/139; 367/117, 191, 901, 903

[56] References Cited

U.S. PATENT DOCUMENTS

| | | | |
|---|---|---|---|
| 3,828,336 | 8/1974 | Massa | 340/540 |
| 3,846,779 | 11/1974 | Martner | 340/540 |
| 3,863,196 | 1/1975 | Hilles | 340/540 |
| 3,942,176 | 3/1976 | Bright | 340/540 |
| 3,986,182 | 10/1976 | Hackett | 340/540 |
| 4,206,449 | 6/1980 | Galvin et al. | 340/505 |
| 4,254,483 | 3/1981 | Vivodic | 367/94 |
| 4,263,665 | 4/1981 | Watts | 367/94 |
| 4,319,349 | 3/1982 | Hackett | 367/94 |
| 5,552,767 | 9/1996 | Toman | 340/540 |

*Primary Examiner*—Glen Swann
*Attorney, Agent, or Firm*—James M. Spicer

[57] ABSTRACT

A wireless boundary monitor system used to monitor the integrity of a boundary surrounding an area uses at least two housings having at least one transmitting means for emitting ultrasonic pressure waves to a medium. Each of the housings has a plurality of receiving means for sensing the pressure waves in the medium. The transmitting means and the receiving means of each housing are aimable and communicably linked. At least one of the housings is equipped with a local alarm means for emitting a first alarm indication whereby, when the pressure waves propagating from a transmitting means to a receiving means are sufficiently blocked by an object a local alarm means or a remote alarm means or a combination thereof emit respective alarm indications. The system may be reset either manually or automatically. This wireless boundary monitor system has useful applications in both indoor and outdoor environments.

17 Claims, 3 Drawing Sheets

WIRELESS BOUNDARY MONITOR SYSTEM AND METHOD

This invention was made with Government support under contract DE-AC05-84OR21400 awarded by the U.S. Department of Energy to Lockheed Martin Energy Systems, Inc. and the Government has certain rights in this invention.

FIELD OF THE INVENTION

The present invention relates to pressure wave systems and devices, and more particularly to pressure wave systems used as detection systems having a plurality of transducers operating in the ultrasonic frequency range for the purpose of monitoring the integrity of an area.

BACKGROUND

Children playing within a residential yard or a playground area tend to wander beyond the boundaries of an area established by a parent or teacher. This tendency is especially hazardous when large groups of children are playing in an area bounded by vehicular traffic or other threats to the safety of the children. Constant monitoring of children by an observer or a group of observers is necessary to ensure their safety. However, even with the most proficient observer, a child may separate from the group when the group of children playing is too large for the number of observers.

Conventional means for containing children or pets within an area generally require an alteration of the area to be bounded. An example of such an alteration would be the addition of a fence around a residential yard. Installing a fence may be undesirable in some applications. However, the need to safely monitor children or pets for containment within a specified area still exists.

In practice, the simple and well known technique of transmitting and receiving ultrasonic pressure waves through a medium is exceedingly difficult to achieve over distances exceeding approximately 20 feet in outdoor applications due to a number of environmental factors such as diminished ultrasonic pressure levels present at the receiving means attributable to attenuation of the ultrasonic energy as the pressure wave passes through the air medium. Additionally, air turbulence, e.g., wind and convective heating of air over a region or area also creates substantial disruption to the ultrasonic pressure wave transmission and can result in unacceptable system performance over distances greater than 20 feet, especially in outdoor applications.

Therefore, a need exists to provide a safe, discrete means for monitoring children to prevent a child from straying beyond the limitations or boundaries established by a parent, guardian or supervisory authority. Additionally, the system should benefit the user by not requiring excessive mounting of hardware or assembly or extensive technical knowledge by the installer.

OBJECTS OF THE INVENTION

Accordingly, it is an object of the present invention to provide a new and improved wireless boundary monitoring system for detecting the ingress or egress through the perimeter of an area being monitored.

It is another object of the present invention to provide a system which is easily installed by an unskilled user.

It is another object of the present invention to provide a system which is safe and reliable for use in an outdoor environment.

Further and other objects of the present invention will become apparent from the description contained herein.

SUMMARY OF THE INVENTION

In accordance with one aspect of the present invention, a wireless boundary monitor system comprises at least one housing having integral transmitters and receivers and at least one alarm means. There are at least two housings having at least one transmitting means for emitting ultrasonic pressure waves to a medium. Each of the housings have a plurality of receiving means for sensing the pressure waves in the medium. The transmitting means and the receiving means of each housing are aimable and communicably linked. At least one of the housings is equipped with a local alarm means for emitting a first alarm indication, whereby when the pressure waves propagating from a transmitting means to a receiving means are sufficiently blocked by an object the local alarm means emits the first alarm signal.

In accordance with a second aspect of the present invention, an apparatus for ingress and egress detection comprises a housing having transmitters and receivers. The apparatus comprises a signal generator means for developing an output signal, a plurality of transmitting means for transducing the output signal of the signal generator means and impressing ultrasonic pressure waves to a medium. Each of the transmitting means is connected to the signal generator means. A plurality of smoothing circuits have a receiving means for receiving the pressure waves from the medium and transducing the pressure waves into an input signal. Each of the smoothing circuits resolves the respective input signals to corresponding conditioned signals. A summing circuit for superimposing the plurality of conditioned signals and developing a sum signal therefrom electrically communicates with each of the smoothing circuits. An adjustable threshold level control means produces a reference signal. A comparison means evaluates the sum signal with respect to the reference signal, the comparison means selectably issues a command signal, the comparison means electrically communicates with the summing circuit and the adjustable threshold level control means and the signal generator means. A plurality of controllable alarm means emit alarm indications. Each of said alarm means electrically communicates with the comparison means, whereby the command signal is issued by the comparison circuit upon attenuation of the pressure waves transmitted from the transmitting means to the receiving means and the plurality of controllable alarm means emit annunciation signals and the signal generator means is deactivated.

In accordance with a third aspect of the present invention, a method for ingress and egress detection comprises transmitting, receiving and interpreting ultrasonic signals. The method comprises the steps of transmitting ultrasonic pressure waves and impressing the pressure waves on a medium, receiving the pressure waves from the medium, producing a plurality of corresponding input signals, smoothing each of the input signals and developing a conditioned signal therefrom, superimposing each of the conditioned signals and producing a resultant sum signal, producing a reference signal, comparing the sum signal to the reference voltage, issuing a command signal resulting from the comparison and activating a local alarm means and emitting a first alarm indication therefrom upon receiving the command signal, whereby said local alarm means emits a first alarm indication when said pressure wave transmission from said transmitting means to said receiving means is sufficiently blocked.

For a better understanding of the present invention, together with other and further objects, advantages and capabilities thereof, reference is made to the following disclosure and appended claims in connection with the above-described drawings.

DETAILED DESCRIPTION OF THE INVENTION

Figure 1:
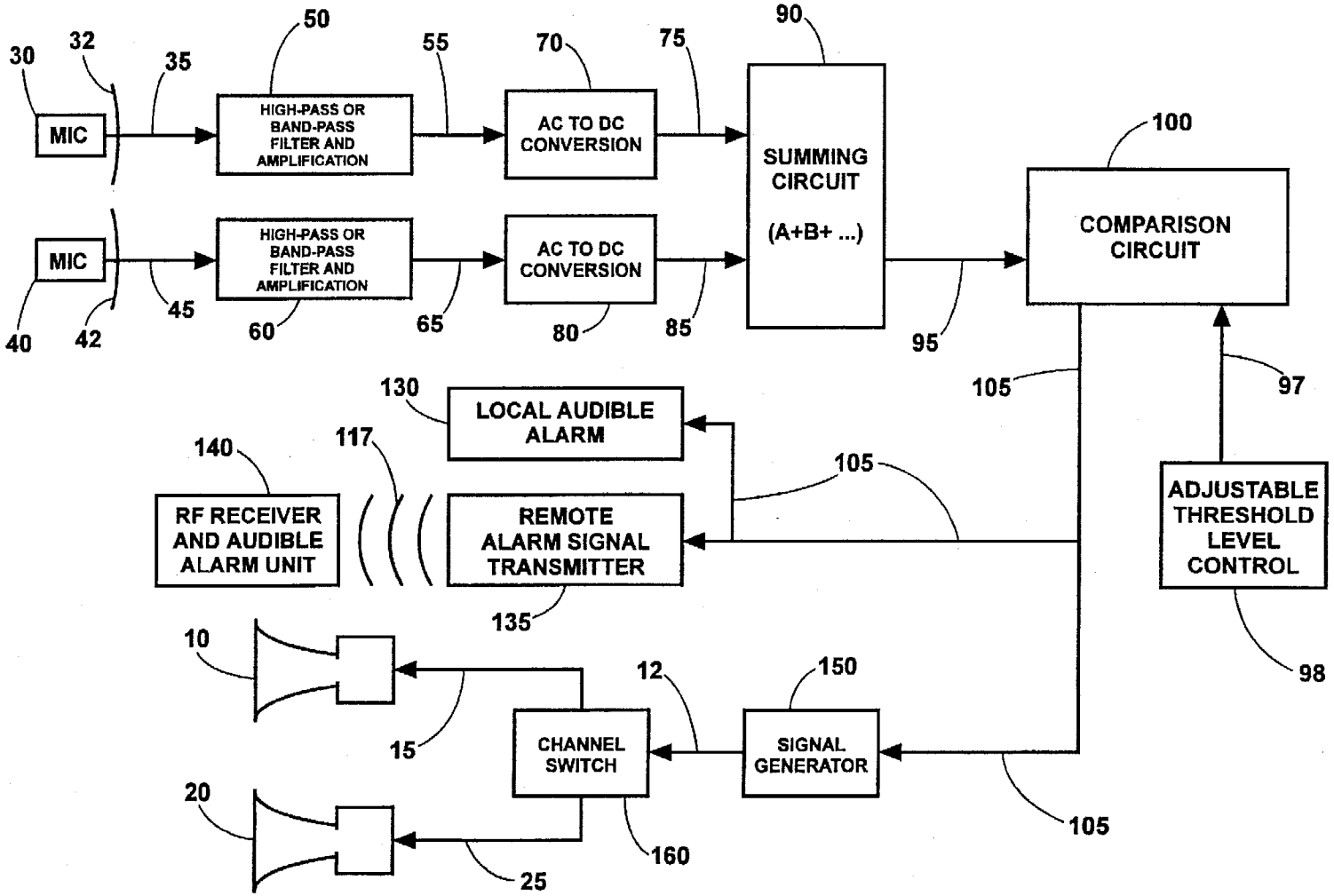
FIG. 1 is a functional block diagram describing the functional aspects of the circuitry within each housing.

Referring now in detail to the drawings wherein like parts are designated by like reference numerals throughout, there is illustrated in FIG. 1 a functional block diagram showing the preferred embodiment of the apparatus of the present invention. The preferred embodiment of the invention utilizes a receiving means, a filtering means, a summation and comparison means coupled to a switching means to activate local and remote alarm means to accomplish the objects of the instant invention.

The operating principle of the wireless boundary monitor (WBM) is based upon the principle that pressure waves passing through a medium from an emitting source to a receiver may be sufficiently attenuated by an obstruction therebetween and that the attenuation may be detected and distinguished from other spurious signals. With reference to FIG. 1, one or more proximate speakers 10 and 20 transduce electrical signals 15 and 25 into respective collimated beams of ultrasonic pressure waves aimed and transmitted through a medium such as air toward two or more distal microphones 30 and 40 which receive the ultrasonic pressure waves and transduce the ultrasonic pressure waves back into respective electrical input signals 35 and 45. When an obstruction passes between the speakers 10 and 20 and the microphones 30 and 40 respectively, the amplitude of the collimated beam transmitted therebetween is attenuated. Accordingly, a corresponding and proportional decrease in the magnitude of the electrical signals 35 and 45 provided by the microphones 30 and 40 is sensed. An electronic circuit 100 compares the magnitude of the electrical sum signal 95 resultant from the input signals 35 and 45 to a fixed, preset threshold signal level 97. Alarms 130 and 140 are triggered when the magnitude of the sum signal 95 falls below the preset threshold reference signal 97.

A functional block diagram for the WBM is provided in FIG. 1. The block diagram illustrates several elements which together provide a means of accomplishing the objects of the invention while minimizing anomalous indications or alarms due to environmental factors as previously discussed. The first of these elements is the incorporation of conventional parabolic dish collectors 32 and 42 with receiving devices 30 and 40, respectively. The parabolic dish collectors 32 and 42 are connected to receiving devices 30 and 40 in a manner well known to one of ordinary skill in the art. Receiving devices such as microphones are preferred. Parabolic dish collectors 32 and 42 dramatically increase the sensitivity and directional characteristics of the receiving devices 30 and 40, thereby rendering the receiving devices 30 and 40 better suited for a variety of WBM applications. The receiving devices transduce the received ultrasonic pressure wave to input signals 35 and 45. The input signals 35 and 45 are received by high-pass or band-pass filter circuits 50 and 60 having an amplification stage. The amplification stage may be either integral with the high-pass or band-pass filter circuits 50 and 60 or may be a separate circuit. The use of amplification and high-pass or band-pass filter circuits 50 and 60 provide a means of increasing the signal-to-noise ratio of the WBM system by attenuating signals having frequencies outside of the frequency band of interest and passing conditioned signals 55 and 65 as outputs. The frequency band of interest is generally determined by the performance parameters of the transmitting means. Optimal frequency ranges fall just above the uppermost limit of the range of audible sound, approximately 20 KHz to 25 KHz. However, the WBM may be adapted to incorporate transmitting means capable of transmitting signals having frequencies much greater than the optimal range without significant degradation in system performance. By amplifying only the portions of signals 35 and 45 having a frequency similar to the ultrasonic pressure wave being transmitted by the speakers 10 and 20, sensitivity to beam blockage is enhanced.

The filtered and amplified signals 55 and 65 are smoothed to produce conditioned signals 75 and 85 by any of several traditional rectification means 70 and 80. These rectification means 70 and 80 may comprise either a synchronous or asynchronous amplitude demodulation circuits or a simple rectifier means. Each rectification means 70 and 80 includes a ripple filter to minimize ripple components in the conditioned signal waveform without sacrificing the tracking speed of the final conditioned signal to the fluctuating amplitude of the input amplified waveform.

Another element shown in the block diagram of FIG. 1 which dramatically improves distance and wind handling capabilities is the summing circuit 90. The summing circuit 90 receives and sums the conditioned signals 75 and 85 to generate a composite sum signal 95. The summing circuit 90 helps smooth out the fluctuations present in the conditioned signals 75 and 85 caused by localized air turbulence. Since wind conditions are not identical at each microphone, the summing circuit 90 acts to cancel most of the apparent random fluctuations seen at each microphone without losing sensitivity to major signal changes due to ultrasonic pressure wave obstructions seen at all microphones. The output composite sum signal 95 from the summing circuit 90 is then compared by the comparison circuit 100 to a reference signal 97 adjusted by threshold control 98. The comparison circuit 100 has an output which resides in a normally idle state until a beam blockage event is encountered. When a beam blockage event occurs, the comparison circuit 100 generates a command signal 105. The command signal 105 is emitted by the comparison circuit 100 when the magnitude of the sum signal 95 is less than the magnitude of the reference signal 97. The reference signal 97 may be adjusted by the user to a threshold level wherein spurious blockage events caused by wind or other environmental conditions do not trigger the activation of the command signal 105.

Activation of the command signal 105 serves to trigger activation of alarm devices 130 and 140 and deactivation of signal generation mechanism 150. Upon receiving the command signal 105, the local audible alarm 130 is activated and issues an audible signal from a housing in the WBM system.

Additionally, the command signal 105 activates a remote alarm transmitter 135 which produces a rf signal 117 and transmits the rf signal 117 through a medium to a remote alarm unit 140 which receives the rf signal 117 and automatically triggers an alarm at the remote unit 140. The command signal 105 also deactivates the signal generator 150 which in turn discontinues signal 12 thereby ceasing emission of ultrasonic pressure waves from speakers 10 and 20. It is preferred that the speakers 10 and 20 work alternative to each other, i.e., when one speaker is active the other speaker or speakers are inactive, to avoid transmission problems caused by destructive interference phenomena. This is accomplished via implementation of a channel switch 160 which alternatively passes the generated signal 12 to each of the speakers 10 and 20 connected to the channel switch 160. More than two speakers may be connected to channel switch 160. In an embodiment wherein only one speaker is used, it will be obvious to one of ordinary skill in the art that the channel switch 160 is not required.

The system is operating correctly when the command signal 105 is issued in response to beam-blockage events only. To achieve this, the reference signal 97 is set at the adjustable threshold level control 98 by the user so that the summing circuit output signal 95 does not fall below the magnitude of the reference signal 97 under wind turbulence conditions. Such a setting precludes the spurious activation and deactivation of alarm and signal generation mechanisms 130, 140 and 150, respectively.

Figure 2:
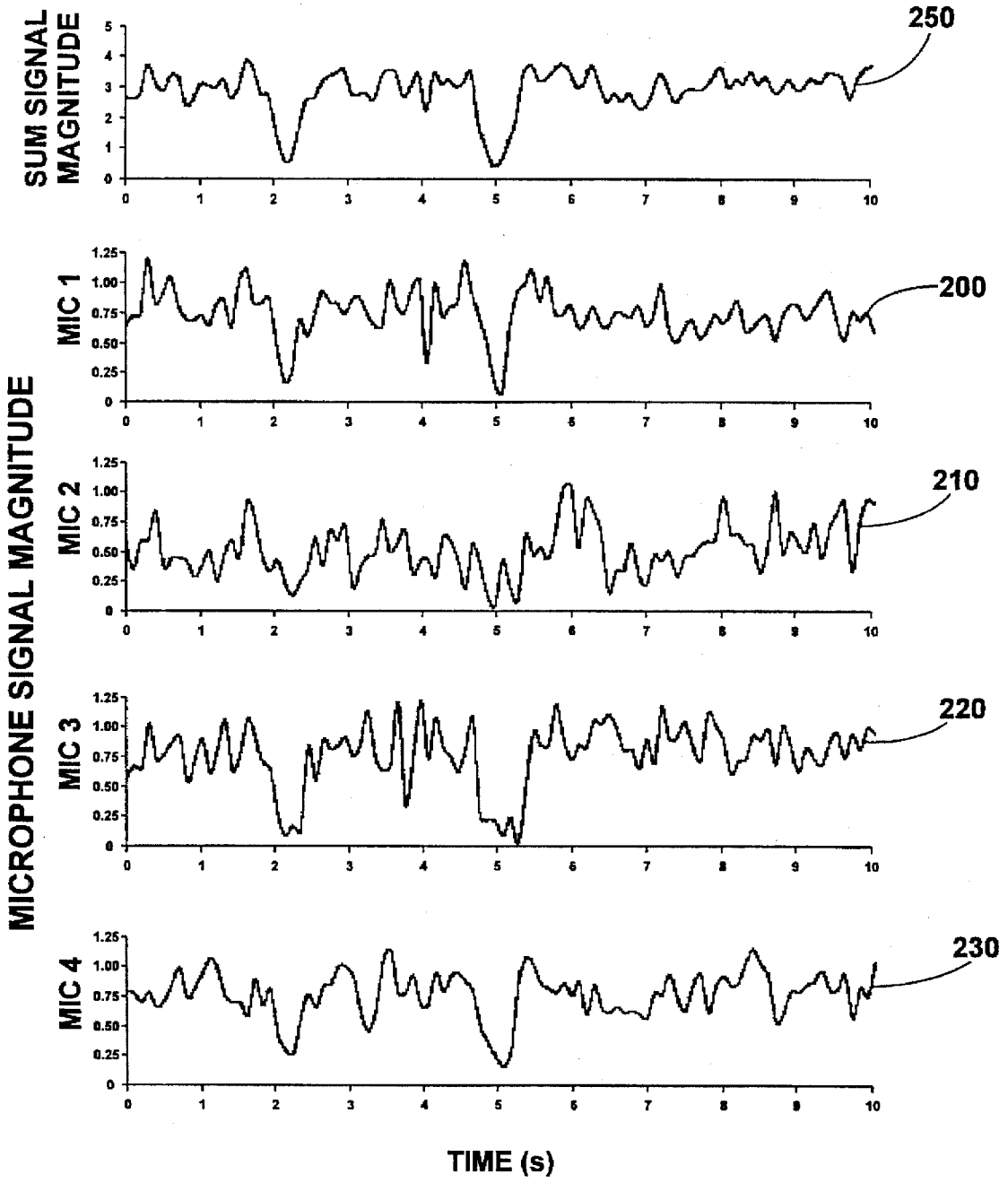
FIG. 2 is a composite response graph displaying unitary magnitudes with respect to time for the experimental responses of each of four smoothed signals as developed by four respective receiving means and the resultant sum signal developed therefrom.

FIG. 2 provides a graphical illustration of experimental results showing the signal improvements provided by the use of multiple microphones and a summing circuit as shown in the embodiment described by FIG. 1. In this example, experimental signals 200, 210, 220 and 230 from four separate and distinct microphones, MIC 1, MIC 2, MIC3 and MIC 4, respectively, generated in response to received ultrasonic pressure waves. Each of the experimental response curves contain both "random" fluctuations and attenuated signals caused by ultrasonic pressure wave blockage, also referred to as a beam blockage event. As shown in FIG. 2, the ratio of the ultrasonic pressure wave blockage signal change to the random signal change is enhanced dramatically by the SUM signal 250, compared to each of the independent MIC signals 200, 210, 220 and 230. This improvement is also summarized by Table 1.

TABLE 1

Improvement in Signal-to-Noise Ratio Resulting From Summing Circuit

| Signal Source | Random Signal Δ (B) | Beam Blockage Δ (A) | Signal-to-Noise Ratio (A)/(B) |
|---|---|---|---|
| MIC 1 SIGNAL | 0.80 | 0.88 | 1.09 |
| MIC 2 SIGNAL | 1.08 | 0.38 | 0.35 |
| MIC 3 SIGNAL | 0.83 | 0.75 | 0.91 |
| MIC 4 SIGNAL | 0.80 | 0.80 | 1.00 |
| SUM SIGNAL | 1.10 | 2.5 | 2.27 |

Figure 3:
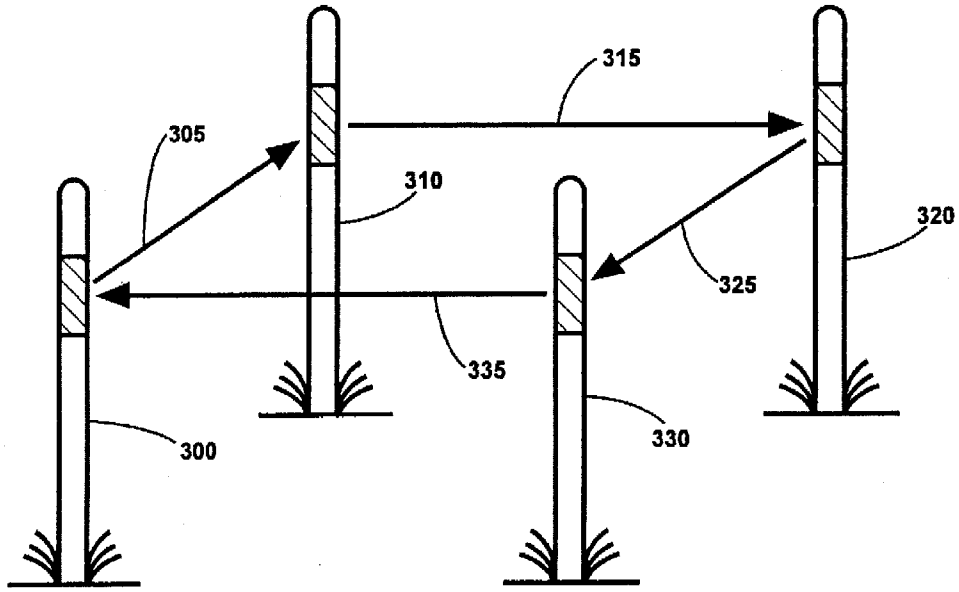
FIG. 3 is a pictorial representation of the wireless boundary monitor system having four housings.

When the WBM system is operating and "active," the local alarm 130 and remote alarm 140 are each in an "off" state and ultrasonic signals are alternatively initiated by the speakers 10 and 20. If the WBM system detects a beam blockage event, a local alarm 130 is activated, an rf signal 117 is transmitted to the remote alarm unit 140 to activate the remote alarm and the signal generator 150 is deactivated. Since the ultrasound is deactivated in response to a beam blockage event, this allows the WBM system to be operated in a series mode as shown in FIG. 3. The series mode sequence is initiated by housing 300 transmitting ultrasonic signal 305 to housing 310. Upon reception of a "healthy" ultrasonic signal, housing 310 transmits an ultrasonic signal 315 to housing 320. Similarly, housing 320 transmits ultrasonic signal 325 to housing 330. Housing 330 completes the series loop by transmitting ultrasonic signal 335 to housing 300. If any signal 305, 315, 325 or 335 is blocked by an obstruction resulting in significant attenuation of the ultrasonic signal, the housing receiving the respective attenuated ultrasonic signal will not emit the next subsequent ultrasonic signal in the series loop. Consequently, the next downstream housing will not receive a "healthy" ultrasonic signal and will shut down. This process will continue in series fashion until each of the transmitters in the series loop is deactivated. As the sequential deactivation of the transmitters propagates around the boundary loop, each of the housings having either a local alarm 130 or a local alarm signal transmitter 135 assumes an alarming mode wherein the command signal 105 is issued thereby activating the local alarm 130 and the local alarm signal transmitter 135, if so equipped, which in turn activates the remote alarm unit 140. Several combinations of alarm units may be employed in the WBM system. There are several possible embodiments to the WBM system with respect to the alarm units. These embodiments range from equipping the WBM system with only one housing in the boundary loop being equipped with a local alarm to each housing being equipped with a local alarm and a local alarm signal transmitter or any alarm unit combination therebetween. It is obvious that the WBM system could also be configured to have only a remote alarm embodiment as well. The WBM system may be reset and reinitiated either manually, or automatically after a preset period has elapsed.

Figure 4:
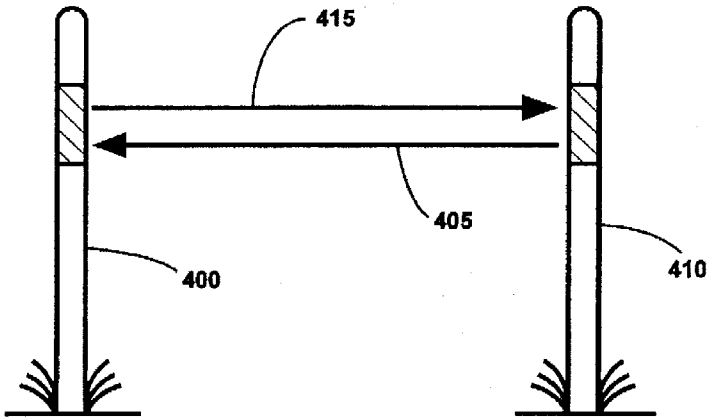
FIG. 4 is a pictorial representation of the wireless boundary monitor system having two housings.

As seen in FIG. 4, a similar WBM system series relationship may be established using only two housings 400 and 410 wherein two pairs of housings may be clearly identified. The first pair of housings is identified with respect to a transmitted ultrasonic pressure wave 415 in which housing 400 transmits ultrasonic signal 415 to housing 410. The second pair of housings is identified with respect to a transmitted ultrasonic pressure wave 405 in which housing 410 transmits ultrasonic signal 405 to housing 400 thereby completing the series loop. Shut down procedures for this embodiment are similar to those previously described.

While there has been shown and described what is at present considered the preferred embodiments of the invention, it will be obvious to those skilled in the art that various changes and modifications can be made therein without departing from the scope of the invention defined by the appended claims.

What is claimed is:

1. A system for ingress or egress detection and annunciation comprising at least two housings, each of said housings having at least one transmitting means for emitting pressure waves having a frequency in the ultrasonic range and impressing the pressure waves to a medium, each of said housings having a plurality of receiving means for sensing the pressure waves in the medium, said transmitting means and said receiving means aimable and communicably linked, at least one of said housings having a local alarm means for emitting a first alarm indication; whereby, when the pressure waves propagating from said transmitting means to said receiving means are sufficiently blocked by an object said local alarm means emits the first alarm signal.

2. The system of claim 1, said medium having a boundary having a plurality of nodes, each of said nodes of said boundary being defined by a housing, said transmitting means of said housings being sequentially and communicably linked with said receiving means of another of said housings to define said boundary.

3. The system of claim 1 wherein at least one of said housings has a communications means for emitting a communications signal when the pressure waves propagating to said one of said housings are sufficiently blocked by an object.

4. The system of claim 3 further comprising a remote alarm means for emitting a second alarm indication upon receiving the communications signal, said remote alarm means being communicably connected with each of said communications means.

5. The system of claim 1 wherein each said transmitting means is a speaker.

6. The system of claim 1 wherein each said receiving means is a microphone.

7. The system of claim 6 wherein each said microphone includes a parabolic focusing means for focusing the pressure waves received from the medium into said microphone for improved sensitivity of said microphone.

8. An apparatus for ingress or egress detection and annunciation, comprising:

a) a signal generator means for developing an output signal;

b) a plurality of transmitting means for transducing the output signal of said signal generator means and impressing pressure waves to a medium, the pressure waves having a frequency in the ultrasonic range, each of said plurality of transmitting means being connected to said signal generator means;

c) a plurality of smoothing circuits, each of said smoothing circuits having a receiving means for receiving the pressure waves from the medium and transducing the pressure waves into an input signal, each of said smoothing circuits resolving the respective input signals to corresponding conditioned signals;

d) a summing circuit for superimposing the plurality of conditioned signals and developing a sum signal therefrom, said summing circuit electrically communicable with each of said smoothing circuits;

e) an adjustable threshold level control means for producing a reference signal;

f) a comparison means for evaluating the sum signal with respect to the reference signal, said comparison means selectably issuing a command signal, said comparison means electrically communicable with said summing circuit and said adjustable threshold level control means and said signal generator means; and g) at least one controllable alarm means for emitting alarm indications, each of said alarm means electrically communicable with said comparison means, whereby the command signal is issued by said comparison circuit upon attenuation of the pressure waves transmitted from said transmitting means to said receiving means and said plurality of controllable alarm means emit annunciation signals and said signal generator means is deactivated.

9. The apparatus of claim 8 further comprising a channel switch means for alternately activating each of said transmitting means and passing the output signal to said active transmitting means, said channel switch means being electrically connected to said signal generator means and receiving the output signal, said channel switching means being electrically connected to each of said transmitting means.

10. The apparatus for ingress or egress detection and annunciation as claimed in claim 8 wherein each of said smoothing circuits further comprises:

a) a filter means for receiving and passing portions of the input signal corresponding to the ultrasonic pressure waves, said filter means having an amplifier providing an amplified signal corresponding to said passed portions of said input signal, said filter means electrically communicating with said receiving means; and b) a rectifying means for receiving the amplified signal and converting the amplified signal to a conditioned signal, said rectifying means electrically communicating with said filter means.

11. The apparatus of claim 8 wherein each said transmitting means is a speaker.

12. The apparatus of claim 8 wherein each said receiving means is a microphone.

13. The apparatus of claim 8 wherein each said microphone includes a parabolic focusing means for focusing the pressure waves received from the medium into said microphone for improved sensitivity of said microphone.

14. The apparatus of claim 8 wherein each of said controllable alarm means comprises:

a) a local alarm means for emitting a first alarm indication at said housing; and b) a remote alarm means having a signal transmitting means for emitting a communicable signal upon issuance of the command signal and a remote receiving means for receiving the communications signal and emitting a second alarm indication upon receiving the communications signal, said signal transmitting means electrically communicating with said comparison means, said remote receiving means oriented in a communicating relationship with said signal transmitting means.

15. A method for ingress and egress detection and annunciation comprising the steps of:

a) transmitting pressure waves having a frequency in the ultrasonic range and impressing the pressure waves on a medium;

b) receiving the pressure waves from the medium;

c) producing a plurality of corresponding input signals;

d) smoothing each of the input signals and developing a conditioned signal therefrom;

e) superimposing each of the conditioned signals and producing a resultant sum signal;

e) producing a reference signal;

f) comparing the sum signal to the reference signal;

g) issuing a command signal resulting from said comparison; and h) activating a local alarm means and emitting a first alarm indication therefrom upon receiving the command signal, whereby said local alarm means emits a first alarm indication when said pressure wave transmission from said transmitting means to said receiving means is sufficiently blocked.

16. The method of claim 15 further comprising the step of ceasing said transmission of pressure waves upon issuance of the command signal.

17. The method of claim 15 further comprising the steps of:

a) issuing a communications signal in response to the command signal; and b) activating a remote alarm means and emitting a second alarm indication therefrom in response to the command signal.

* * * * *